US005356035A

United States Patent [19]

Shlopak et al.

[11] Patent Number: 5,356,035

[45] Date of Patent: Oct. 18, 1994

[54] ORNAMENTED CANDY DISPENSER

[75] Inventors: Gregory P. Shlopak, Rockport; Ronald Magers, Essex, both of Mass.

[73] Assignee: Cyrk, Inc., Gloucester, Mass.

[21] Appl. No.: 829,928

[22] Filed: Feb. 3, 1992

[51] Int. Cl.[5] ..... G07F 11/00

[52] U.S. Cl. ..... 222/78; 222/548; 222/498

[58] Field of Search ..... 222/519, 498, 520, 548, 222/549, 555, 78; 221/24, 266, 277

[56] References Cited

U.S. PATENT DOCUMENTS

| | | | |
|---|---|---|---|
| 2,780,395 | 2/1957 | Schlabach et al. | 222/548 X |
| 2,885,128 | 5/1959 | Zimmerli | 222/548 X |
| 2,961,132 | 11/1960 | Ankney | 222/548 X |
| 3,099,365 | 7/1963 | Johnson | 221/24 X |
| 3,100,589 | 8/1963 | Love, Jr. | 222/548 X |
| 3,339,810 | 9/1967 | Block et al. | 222/548 X |
| 3,357,605 | 12/1967 | Chadfield | 222/548 X |
| 3,409,009 | 11/1968 | Vasse | 222/548 X |
| 3,435,804 | 4/1969 | Orlowski | 222/548 X |
| 3,463,364 | 8/1969 | Rehag | 222/548 X |
| 3,467,287 | 9/1969 | Marchant et al. | 222/548 X |
| 3,494,515 | 2/1970 | Fattori | 222/548 |
| 3,651,998 | 3/1972 | Rocher | 222/548 X |
| 4,091,965 | 5/1978 | Gebhard | 222/548 X |
| 4,657,139 | 4/1987 | Hanifl | 222/548 X |
| 4,792,054 | 12/1988 | Weidman | 222/548 X |
| 4,838,457 | 6/1989 | Swahl et al. | 222/548 X |
| 4,978,030 | 12/1990 | Morris et al. | 222/78 X |
| 5,058,778 | 10/1991 | Weinstein | 222/548 X |

*Primary Examiner*—Andres Kashnikow
*Assistant Examiner*—Kenneth DeRosa
*Attorney, Agent, or Firm*—Wolf, Greenfield & Sacks

[57] ABSTRACT

A hand-held ornamented candy dispenser in the form of a candy figure, has a dispenser body with a storage chamber for candy which can be in opened or closed positioned as determined by novel closure member, to allow storage and dispensing of candy portions.

2 Claims, 2 Drawing Sheets

ORNAMENTED CANDY DISPENSER

BACKGROUND OF THE INVENTION

Many toy caricatures and figures are known for use as dolls, dispensers of various types, or a combination of both ornamented dispensers and ornamented toys. When such toy figures are used as dispensers, various means are used to enclose various materials stored within bodies or other portions of the toy figures. In some cases, toy figures have been used to store and dispense candy portions, as in gum machines, and toy figures in the form of dolls and characters.

The construction of various loading and closure devices to enable storage and dispensing of candy portions presents challenges in terms of designing low-cost, easily operable, effective devices which can be easily manipulated by children and others.

SUMMARY OF THE INVENTION

It is an object of this invention to provide storing and dispensing devices which can be efficiently manufactured at reasonable cost and which can be operated by children, to enable loading and dispensing of desired portions of materials such as candy M&M's.

Still another object of this invention is to provide devices in accordance with the preceding object which can be manufactured using essentially standard manufacturing procedures and which can be hand-held and ornamented for use in dispensing candy and can have the form of a toy figure, as desired.

Still another object of this invention is to provide devices in accordance with the preceding objects which provides an easily operable closure device which can act to provide a candy loading opening of a first size, a candy dispensing opening of a second size, and yet provide a closed position by simple manual manipulation and which can be hand-held by a user.

According to the invention, a hand-held, ornamented candy dispenser, preferably in the form of a figure such as an M&M toy figure, is used in storing and dispensing of candy portions of predetermined size, as for example M&M sizes. The dispenser has a body defining a storage chamber, with a wall defining a receiving and dispensing opening. The wall carries first means for mechanically mounting and locking a closure member on the wall, while permitting reciprocal movement of the closure member into at least two positions of the closure member, with one position permitting dispensing of candy portions from the chamber and a second position locking the candy portions in the chamber.

Preferably, the closure member is in the form of a disc which rotates about a central axis on a bearing surface and is mounted for movement into an additional third position which permits east of loading candy portions into the chamber. In the preferred form, the disc is mounted on a pin which has a split end which snaps into place in a circular bearing of the body to mount the disc for rotation about the axis on the bearing surface. Detent means provide for determining a first open position which is a dispensing position allowing candy portions such as M&M's to be dispensed into the hand of the user, and a limit means determines a second open position where the opening to a candy storage chamber is enlarged, allowing ease of filling. Another position of the disc, with respect to the body, closes the chamber. The disc is preferably arcuate in cross-section and a portion of a sphere to enhance resilient engagement with the body.

Preferably, the portion of the disc defining an opening also carries a finger grip to enable ease of rotation of the disc and the bearing surface is a circular surface so that complimentary bearing surfaces of the disc and rear wall co-act with each other to permit sliding of the disc and holding in place of the disc, due to the resilient pivot mounting in desired rotational positions.

It is a feature of this invention that the closure member is not complicated, one piece, and can be snapped into position for assembly. Because of the resiliency of the materials which are preferably plastics, the disc retains its ability to slide on the bearing surfaces and be held in various arcuate positions about the central axis of the pivot pin. The detentment means are simple, yet provide positive stops, as does the limit means. The body itself can be formed into toy figures and can be hand-held, as for example no more than 4 inches in height, as seen in FIG. 1. In the preferred embodiment, the body is an M&M character having an ornamented face view, two legs and two arms for the amusement and entertainment of children and others, while still having the functional feature of acting as a candy dispenser, as for example an M&M storage container and dispenser.

BRIEF DESCRIPTION OF THE DRAWINGS

The above and other features, objects and advantages of the present invention will be better understood from a reading of the following specification in conjunction with the attached drawings in which.

DESCRIPTION OF PREFERRED EMBODIMENTS

Figure 1:
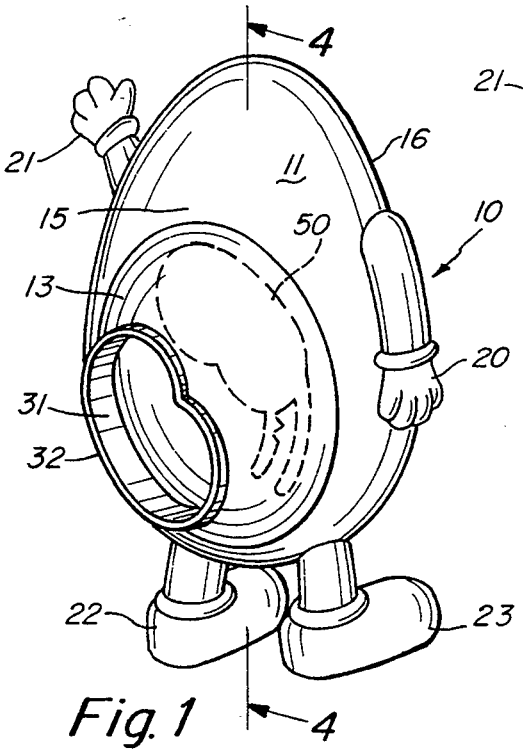
FIG. 1 is a rear perspective view showing an ornamented hand-held candy dispenser in accordance with a preferred embodiment of this invention.

According to the invention, a hand-held, ornamented candy dispenser, in accordance with the preferred embodiment of this invention, is illustrated generally at 10 in FIGS. 1–6 and comprises a shell or body 11 defining a storage chamber 12 and a closure member 13 rotatably secured thereon for rotation about a bearing 14 provided in a rear wall portion 15 of the body. The bearing 14 comprises a first means for mechanically mounting and locking the closure member 13 on the wall portion 15 of wall 11.

The entire dispenser 10 is preferably in the form of a toy figure such as an M&M character having a face not shown and ornamentation on a front portion 16 of the body 11, with hands 20, 21 and legs 22, 23, so that the dispenser can be stood up to appear as an appealing toy caricature to children and others. The toy function of the dispenser and its graphic appearance can be enhanced, as known in the art, in many different ways.

The dispenser 10 is preferably substantially formed entirely of organic polymeric or plastic material. Impact polystyrenes, nylons, polyethylene, polypropylenes, polyvinyl materials, or other plastic materials, can be used as known in the art. Injection molding techniques can be used to form the components which can be assembled in a known manner. While plastics are preferred for use because of ease of molding and assembly, other material can be used if desired.

Generally, the body 11 is capable of retaining its shape and being substantially rigid when held and used as a toy and dispenser. The arms and legs can be glued in place or molded if desired.

Figure 4:
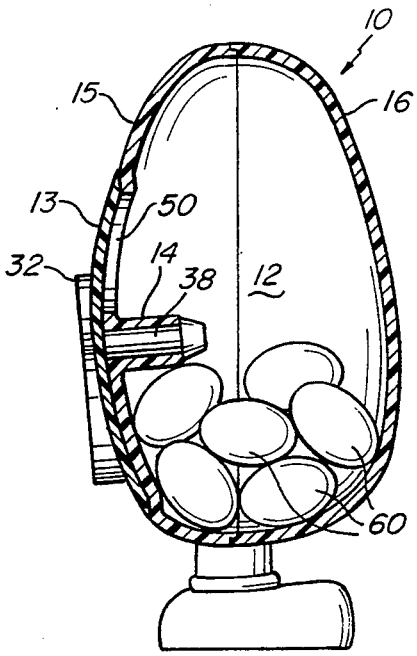
FIG. 4 is a cross-sectional view thereof, taken through line 4—4 of FIG. 1.
Figure 5:
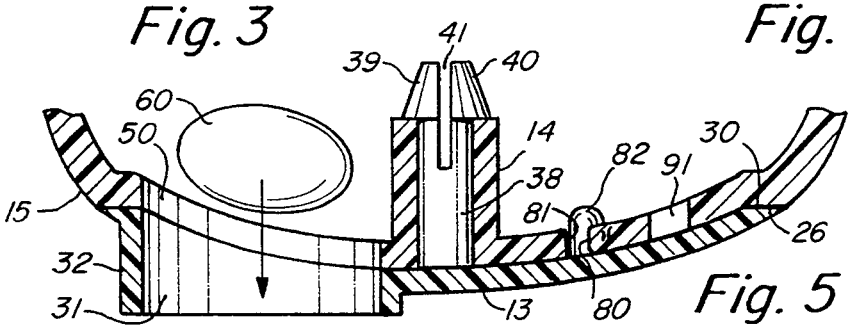
FIG. 5 is a cross-sectional view thereof, taken through line 5—5 of FIG. 2, showing specifics of the closure disc.
Figure 6:
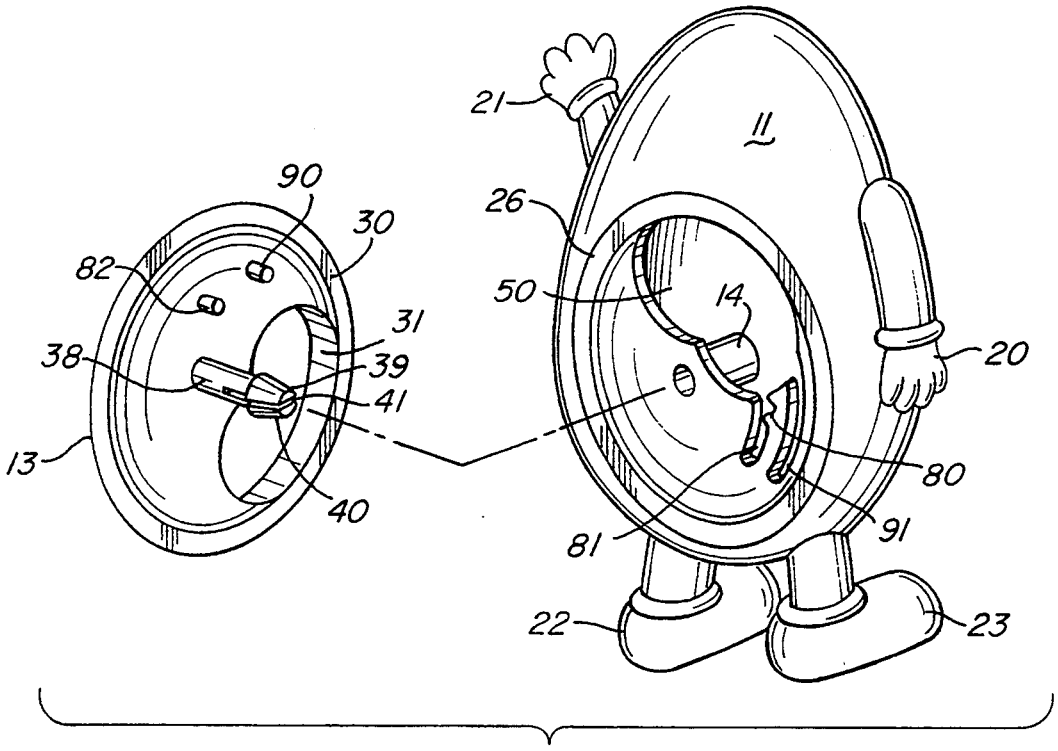
FIG. 6 is an exploded rear perspective view of the hand-held ornamented candy dispenser of the preferred embodiment, showing the closure disc and its associated detent and limit means.

The rear wall portion 15 of the body 11 defines a tubular, preferably integral, bearing tube 4 and a flat, circular bearing surface 26, best shown in FIG. 5, although visible also in FIGS. 4 and 6. A preferably one-piece plastic disc or closure member 13 is mounted on the rear wall portion 15. The disc 30 defines a dispensing and loading opening 31 formed in part by an integral raised kidney shaped wall 32.

The closure member or disc 13 has a central pin 38 which acts as a pivot for the disc about the central axis of the pin. The pin 38 has a resilient end 39, 40 having a central split 41 so that the re-entrant shaped, or arrow shaped ends 39, 40 allow snapping of the disc into place as shown in FIG. 5. The ends 39, 40 move towards each other as the pin is pushed through the bearing tube 14 and then snapped into the position of FIG. 5.

The closure member or disc 13 has a mating bearing surface 30 which is circular and which slides upon the bearing surface 26. When the pin 38 is snapped into position, the bearings are resiliently biased toward each other to a very slight degree. The rear surface of the disc facing the body rear wall is very close to the rear wall, with substantially no space, allowing a sliding action. Because of the resiliency of the plastic and the arcuate cross-section of the disc which is preferably a truncated portion of a sphere, there is a tendency for the disc to remain in any stopped position, due to a slight force created by the snapping in place of the pin.

The rear wall portion 15 defines an opening 50 of large size, as shown in FIG. 6, which can be larger than the opening 31, but is preferably at least the same size. Candy portions such as candy coated chocolate M&M's 60 are shown positioned in the storage chamber 12 formed by the body wall 11.

A positive detent 80, which comprises a narrowed or spiked portion 80' of a slot 81 formed in the rear wall portion 15, is best shown in FIGS. 2, 3, 5 and 6. A detent pin 82 is fixed in place on the disc 13 and slides within the slot 81 which opens to the opening 50. A second limit means comprises a limit pin 90 fixed on the disc 13 and mounted within a second concentric slot 91. Slot 91 also opens into rear opening 50 and the pin 90 acts as a stop pin to define a closed position of the dispenser. Detent 80 acts to define a dispensing position.

The pivot pin 38 is preferably made in two parts. Thus, the pin itself can be separately molded and glued to the disc or to a boss in the disc, as may be desired.

Figure 2:
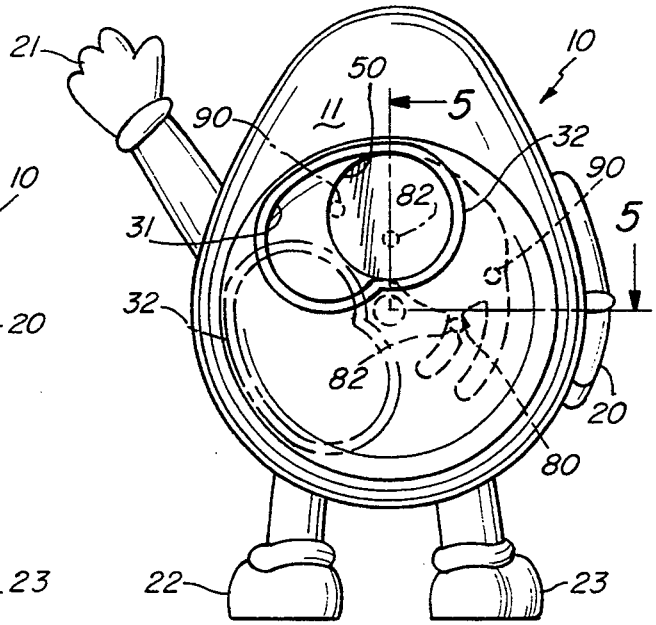
FIG. 2 is a rear view thereof showing an opened dispensing position of the closure member.
Figure 3:
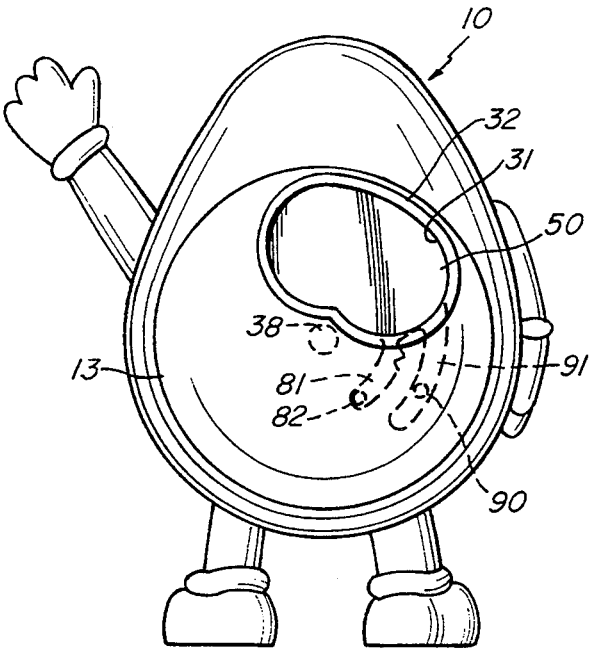
FIG. 3 is a rear view showing a candy load position of the candy dispenser.

In operation of the toy hand-held ornamented candy dispenser, a first position is shown in FIG. 2, where the disc is rotated to an arcuate position so that the detent 80 stops the clockwise movement of the disc and the opening 31 is aligned with the opening 50 in such a manner that a single candy portion at a time can be dispensed. If desired, this position may enable dispensing of more than one portion at a time, but is a somewhat reduced opening to the storage chamber 70 for dispensing. Note that in this position, the resiliency of the disc maintains the position of the disc and the pin 82 must overcome the resiliency of detent 80 before further clockwise rotation of the disc can cause a greater opening. This first, or dispensing, position has a through opening to the chamber of a first small size. Finger pressure on the collar or raised boss 32 by the user, while holding the body in fixed position, enables the disc to rotate clockwise by resiliently snapping the pin over the detent into the position shown in FIG. 3, which is the load position of the disc. In this position, a plurality of M&M's or other candy portions can be loaded into the chamber. Note that the pin 82 can define the furthest clockwise rotation of the disc as it meets the end of the slot 81.

After loading, counter rotation of the disc snaps the pin 82 over the detent 81 and enables full counter-rotation to the closed position shown in FIG. 1, where pin 90 contacts the edge of opening 50 and, thus, defines the limit position which is the closed position as shown in dotted outline in FIG. 2. This closed position locks the candy portions within the storage area. The resiliency of the disc and the pressure, because of the re-entrant nature of the pivot pin 38, causes the bearing surfaces 26 and 30 to firmly contact each other and resist pivoting or rotation about the pin or pivoting of the pin in the bearing tube 14.

It is a feature of this invention that no separate handgrip need be used, but the collar 32 can function as a dispensing and loading opening portion while enabling sliding against the resilient pressure holding the disc in position on the bearing surface. Similarly, although plastics are preferred, and preferably plastics having some resiliency such as impact polystyrenes having a rubbery or resilient nature, or teflon, polypropylene or other materials having desired resiliency characteristics, the materials of one or more of the components of the invention can change. While the body is substantially M&M or egg shaped as shown, various configurations of the toy figure can be used. The positions of arms and legs, and indeed the use of arms and legs, can vary if desired. Ornamentation on the front wall 16 can also vary.

While the storage chamber is substantially closed and sealed, due to the slight resilient action pulling the disc 13 against the bearing surface 26, in some cases vents and other access to the storage chamber can be provided. In the preferred embodiment, the storage chamber is substantially sealed against moisture, dirt and environmental pollutants when in the closed position. This is due, in part, to the flat nature of the bearing surfaces and the slight degree of pressure against each other. While detent and limit pins are preferred, they can be eliminated if desired.

The toy figure is, preferably, hand-held. That is, it is dimensioned so that a small user can hold the device in the palm of the hand while operating the disc with the thumb. In the preferred embodiment, the overall height of the device is about 4 inches, while the width is about 2 inches. However, the size can vary greatly and the closure disc is useful in a number of storage body uses as may be desired, as for example where the storage area is greatly enlarged beyond normal holding in use by a single hand. While M&M candy portions are preferred, the dispensed items can vary greatly. In some cases, other finger grip means for rotating the disc can be used, as can other limit and detent means.

What is claimed is:

1. A candy dispenser comprising:

a container having an interior chamber for holding candy pieces, the container having
a top portion having a curved surface,
a bottom portion having a curved surface, and
a side portion having a single opening;

a rotatable disk having an opening with the opening substantially the same size and shape as the single opening in the side of the container, a first centrally located pin extending from the disk into said side portion of the container adjacent the openings and supporting the disk for rotation;

a finger grip having a ridge extending around the opening in the disk and extending outwardly from the opening in the disk;

means for limiting rotational movement of the disk relative to said side portion to and from at least two positions including a first position in which the openings are not aligned and the container is closed, and a second position in which the openings are at least partially aligned for removal of pieces from the container;

said means for limiting rotational movement including stop means for limiting movement of the disk relative to said side portion, the stop means comprising a second pin extending from one of the side portion or disk and a groove in the other of the side portion or disk rotationally aligned with the second pin and having a length sufficient to permit and limit movement between the positions;

a detent intermediate the end of the groove which mates with the second pin to serve as a first stop for locking the disk in the second position; and wherein the openings are partially aligned in the second position, the groove having a second stop for limiting movement at a third position in which the openings are completely aligned.

2. A candy dispenser comprising:

a container having an interior chamber for holding candy pieces, the container having a top portion, a bottom portion, and side portions having curved surfaces, one of the side portions having an opening;

a closure having an opening;

a finger grip having a ridge extending at least partially around the opening in the closure, the ridge extending away from the opening in the closure;

the closure being movable from a first position in which the openings are not aligned at all, and a second position in which the openings are partially aligned;

a pin extending from the closure and a groove in said one side portion with a detent for locking the closure in the second position; and wherein the closure is movable to a third position in which the opening in the closure and the opening in the container are completely aligned.

* * * * *